United States Patent [19]

Barry et al.

[11] 4,218,179

[45] Aug. 19, 1980

[54] ISOTHERMAL AEROFOIL WITH INSULATED INTERNAL PASSAGEWAY

[75] Inventors: Brian Barry, Duffield, England; David W. Artt, Belfast, Northern Ireland

[73] Assignee: Rolls-Royce Limited, London, England

[21] Appl. No.: 910,753

[22] Filed: May 30, 1978

[30] Foreign Application Priority Data

Jul. 22, 1977 [GB] United Kingdom ..... 30808/77

[51] Int. Cl.[3] ..... F01D 5/08

[52] U.S. Cl. ..... 415/114; 416/96 R

[58] Field of Search ..... 415/114, 175, 177, 178; 416/96 R, 96 A

[56] References Cited

U.S. PATENT DOCUMENTS

| | | | |
|---|---|---|---|
| 2,744,723 | 5/1956 | Roush | 416/96 R |
| 3,287,906 | 11/1966 | McCormick | 60/39.51 |
| 3,314,650 | 4/1967 | McCormick | 415/114 |
| 3,334,685 | 8/1967 | Burggraf | 165/105 |
| 3,370,829 | 2/1968 | Banthin et al. | 416/96 A |
| 3,378,228 | 4/1968 | Davies et al. | 416/96 |
| 3,402,767 | 9/1968 | Bohdansky et al. | 415/114 |
| 4,019,571 | 4/1977 | Kosson et al. | 165/105 |
| 4,108,239 | 8/1978 | Fries | 165/105 |

FOREIGN PATENT DOCUMENTS

| | | | |
|---|---|---|---|
| 938060 | 9/1963 | United Kingdom | 416/96 |
| 243324 | 9/1969 | U.S.S.R. | 416/96 |

OTHER PUBLICATIONS

*Mechanical Engineering*, vol. 89, No. 2, Feb. 1967, pp. 30–33, Feldman, K. T. and Whiting, G. H., "The Heat Pipe."

*Mechanics, Heat, and Sound*, Sears, F. W., Addison-Wesley, Reading, Mass., 1950, pp. 326–329.

*Primary Examiner*—Everette A. Powell, Jr.

*Assistant Examiner*—A. N. Trausch, III

*Attorney, Agent, or Firm*—Cushman, Darby & Cushman

[57] ABSTRACT

An aerofoil blade for a gas turbine engine is in the form of a heat pipe. The aerofoil blade has an internal passageway adapted to contain a secondary structure and to thermally insulate that secondary structure from the remainder of the aerofoil blade by, for instance, the provision of a cooling air passage between the internal passageway and secondary structure.

5 Claims, 3 Drawing Figures

ISOTHERMAL AEROFOIL WITH INSULATED INTERNAL PASSAGEWAY

This invention relates to an aerofoil blade for a gas turbine engine.

It has been proposed to manufacture aerofoil blades for gas turbine engines in the form of heat pipes. This has several advantages, probably the most important of which is that during engine operation each such aerofoil blade remains substantially isothermal. Consequently there is less likelihood of localised overheating of blade parts occurring. While an isothermal aerofoil blade is desirable so far as the avoidance of such things as thermal fatigue and high levels of localised oxidation are concerned, it does present difficulties if there is a necessity to pass certain secondary structure through the aerofoil blade. Thus if, for instance, it is necessary to pass an oil feed pipe through such an aerofoil blade, the isothermal characteristics of the blade will result in any oil within the feed pipe being heated to undersirably high levels. Although not to such an extent, similar problems exist when it is necessary for a structural member to pass through an isothermal aerofoil blade. The high temperatures within an isothermal aerofoil blade necessitate the use of structural members which are either larger and heavier or made from a more exotic alloy than would be the case if a conventional aerofoil blade was employed.

It is an object of the present invention to provide a substantially isothermal aerofoil blade which is adapted to substantially avoid the aforementioned difficulties.

According to the present invention, an aerofoil blade for a gas turbine engine is in the form of a heat pipe, said aerofoil blade having an internal passageway adapted to contain a secondary structure and to thermally insulate said secondary structure from the remainder of said aerofoil blade.

Said internal passageway is preferably adapted to thermally insulate said secondary structure from the remainder of said aerofoil blade by the provision of a cooling fluid passage between said internal passageway and said secondary structure.

Said cooling fluid may be air.

Said cooling air is preferably adapted to flow through said cooling fluid passage so as to provide cooling of said aerofoil blade.

Said secondary structure may comprise an oil feed pipe.

Figure 1:
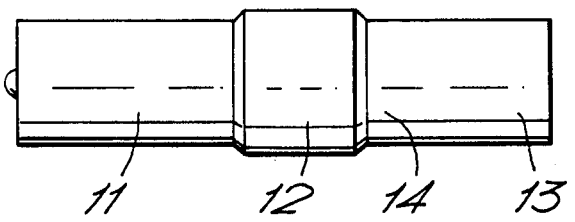
Figure 2:
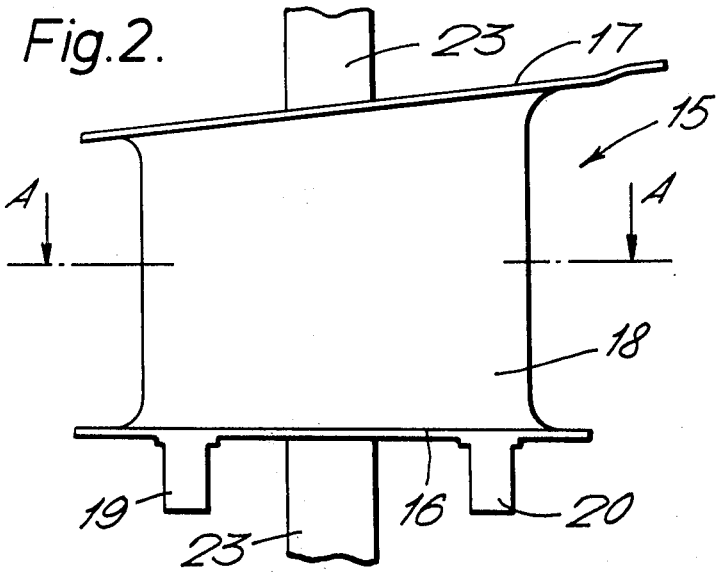
Figure 3:
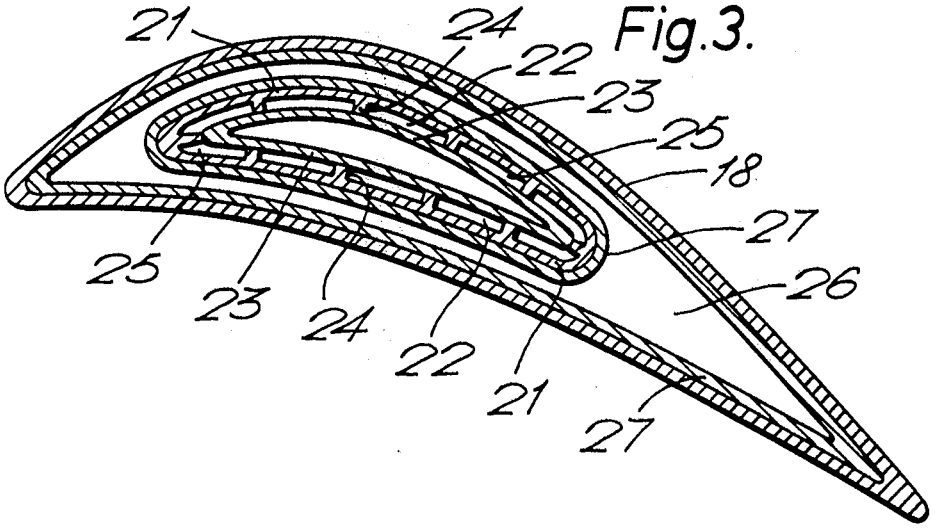

The invention will now be described, by way of example, with reference to the accompanying drawings in which:

FIG. 1 is a side view of a gas turbine engine provided with an aerofoil blade in accordance with the present invention, FIG. 2 is a side view of an aerofoil blade in accordance with the present invention, and FIG. 3 is view on A—A of the aerofoil blade shown in FIG. 2.

With reference to FIG. 1, a gas turbine engine generally shown at 10 comprises a compressor 11, combustion equipment 12 and a turbine 13. The gas turbine engine 10 operates in the conventional manner, that is, air compressed by the compressor 11 is mixed with fuel and combusted in the combustion equipment 12. The resultant hot gases expand through the turbine 13 to atmosphere therby driving the turbine 13 which in turn drives the compressor 11.

Hot gases from the combustion equipment 12 are directed into the high pressure section 14 of the turbine 13 by an annular array of stationary nozzle guide vanes, one of which 15 can be seen in FIG. 2. The nozzle guide van 15 has radially inner and outer shroud members 16 and 17 (with respect to the longitudinal axis of the engine 10) which are separated by an aerofoil section portion 18. Two bosses 19 and 20 are provided on the radially inner shroud 16 by means of which the nozzle guide vane 15 is retained within the turbine 13.

The aerofoil portion 18 of the nozzle guide vane 15 is defined by an outer tubular or hollow wall as can be more easily seen in FIG. 3. An inner tubular or hollow wall 21 contained within and spaced from the outer wall of the aerofoil portion 18 extends between the radially inner and outer shrouds 16 and 17 to define a passageway 22 which in turn contains a secondary structure 23. In this particular case the secondary structure is an oil feed pipe but it will be appreciated that other engine structure could be contained within the passageway 22. A number of ribs 24 provided within the passageway 22 space the secondary structure 23 away from the wall of the passageway 22 so as to define an air gap or spanwise extending space 25 between them. The secondary structure 23 extends through each of the radially inner and outer shrouds 16 and 17 to communicate with other portions (not shown) of the turbine 13.

The wall inner 21 is in sealing contact with each of the radially inner and outer shrouds 16 and 17 so that a sealed cavity or chamber 26 is defined by the inner wall 21 and the outer wall of the aerofoil portion and the radially inner and outer shrouds 16 and 17. The cavity 26 contains a small amount of a heat transfer medium such as sodium and all of its internal walls have capillary means constituted by a stainless steel mesh 27 spot welded to them so that the aerofoil portion 18 is in the form of a heat pipe. Although a stainless steel mesh is used in this particular instance, it will be appreciated that other capillary means such as a porous ceramic material or sintered metal could be utilised.

In operation, hot gases issued from the combustion equipment 12 impinge upon the nozzle guide vanes 15 in such a manner that each guide vane 15 has regions upon its aerofoil surface which are of differing temperatures. The heating up of the nozzle guide vanes 15 results in the melting and subsequent vapourisation of the sodium contained within them. Sodium vapourised in the hotter regions of the guide vanes 15 is transported by vapour pressure differences to the cooler regions where it condenses. Thus the heat required to vapourise the sodium is extracted from those hotter regions and is utilised in heating up the colloer regions upon the condensation in those cooler regions of the sodium vapour. After condensation, the liquid sodium is pumped by capillary action through the stainless steel mesh 27 back to the hotter regions where the cycle is repeated. Thus by the constant vapourisation and condensation of the sodium, each of the nozzle guide vanes 15 assumes a substantially even temperature distribution i.e. each becomes substantially isothermal.

One inevitable result of the guide vane 15 being isothermal is that the inner tubular wall 21 within the outer tubular wall of the the aerofoil portion 18 reaches the same temperature as the hot outer region of the outer tubular wall of the aerofoil portion 18. However the provision of an insulating air gap 25 between the wall 21 and secondary structure 23 ensures that the secondary structure 23 is maintained at a lower temperature than that of the remainder of the aerofoil portion 18.

It is sometimes necessary to cool nozzle guide vanes as a result of temperature limitations imposed upon the alloy from which they are constructed. Such cooling is usually achieved by tapping cooling air from the high pressure section of the engine compressor, passing it through various tortuous passages in the nozzle guide vanes before finally exhausting it through numerous small holes provided in the guide vanes into the hot gas stream flowing over the guide vanes. While this is usually effective in cooling nozzle guide vanes, it is not a thermodynamically efficient arrangement. The use of high pressure cooling air is necessary since various regions of conventional nozzle guide vanes are exposed to very high temperatures and can only be cooled effectively with high pressure air. However since the nozzle guide vane 15 is substantially isothermal, it has no such localised regions of high temperature. Consequently it is possible to provide effective cooling merely be passing low pressure cooling air through the air gap 25. Such cooling air may be tapped from the low pressure section of the compressor 11, passed through the air gap 25 and then exhausted into the low pressure section of the turbine 13. An arrangement of this kind is more thermodynamically efficient than is the case when high pressure cooling air is utilised. Moreover, it is not necessary to provide small holes in the aerofoil portion 18 for the exhausting of the colling air.

Although the present invention has been described with reference to a nozzle guide vane for a gas turbine engine, it will be appreciated that is is applicable to other aerofoil blades which are adapted to contain a secondary structure.

We claim:

1. In a gas turbine engine having compressor means with at least a low pressure section, combustion means and turbine means in flow series, the improvement in an aerofoil blade in the hot gas stream of the gas turbine engine comprising:

a heat pipe having a chamber therein closed at both ends with capillary means within the chamber, said heat pipe further containing a small amount of a heat transfer medium in the chamber capable when subjected to heat of melting, subsequent vaporization and then transportation by vapor pressure differences to a cooler region for condensation and heating up of the cooler region whereby temperature distribution of the aerofoil blade is substantially isothermal, said heat pipe being defined by an outer tubular wall and an inner tubular wall, said outer tubular wall forming a major portion of the aerofoil blade's external configuration, and said inner tubular wall having substantially the same temperature as the outer tubular wall and defining a spanwise internal passageway through the aerofoil blade;

a secondary structure extending completely through said internal passageway of the aerofoil blade, said secondary structure about the exterior thereof being spaced from said inner tubular wall to define a spanwise space extending completely through the aerofoil blade;

a cooling fluid flowing from the low pressure section of said compressor means into, through and out of said spanwise space between the secondary structure and said inner wall of said heat pipe, said cooling air thermally insulating and cooling said secondary structure from the inner wall and outer wall which define the heat pipe of the aerofoil blade.

2. An aerofoil blade for a gas turbine engine comprising:

a heat pipe having a chamber therein closed at both ends and with capilliary means within the chamber, said heat pipe further containing a small amount of a heat transfer medium in the chamber capable when subjected to heat of first melting, subsequent vaporization and then transportation by vapor pressure differences to a cooler region for condensation and heating up of the cooler region whereby temperature distribution of the aerofoil blade is substantially isothermal, said heat pipe being defined by the outer tubular wall and an inner tubular wall, said outer tubular wall forming a major portion of the aerofoil blade's external configuration, and said inner tubular wall having substantially the same temperature as the outer tubular wall and defining a spanwise internal passageway through the aerofoil blade;

a secondary structure extending completely through said internal passageway of the aerofoil blade, said secondary structure about the exterior thereof being spaced from said inner tubular wall to define a spanwise space extending completely through the aerofoil blade;

and a cooling fluid flowing into, through and out of said spanwise space between the secondary structure and said inner wall of said heat pipe whereby said secondary structure is cooled and thermally insulated from the inner wall and outer wall which define the heat pipe of the aerofoil blade.

3. An aerofoil blade for a gas turbine engine as claimed in claim 2 in which said cooling fluid is air.

4. An aerofoil blade as claimed in claim 3 wherein said cooling air is low pressure compressor air.

5. An aerofoil blade for a gas turbine engine as claimed in claim 2 in which said secondary structure comprises an oil feed pipe.

* * * * *